US008627771B1

(12) United States Patent
Gold

(10) Patent No.: US 8,627,771 B1
(45) Date of Patent: Jan. 14, 2014

(54) SELECTABLE FRAGMENT SIZE FRAGMENTATION WARHEAD

(75) Inventor: Vladimir M. Gold, Hillside, NJ (US)

(73) Assignee: The United States of America as Reperesented by the Secretary of the Army, Washington, DC (US)

( * ) Notice: Subject to any disclaimer, the term of this patent is extended or adjusted under 35 U.S.C. 154(b) by 34 days.

(21) Appl. No.: 13/419,801

(22) Filed: Mar. 14, 2012

Related U.S. Application Data

(63) Continuation-in-part of application No. 12/563,474, filed on Sep. 21, 2009, now abandoned.

(51) Int. Cl.
*F42B 12/22* (2006.01)

(52) U.S. Cl.
USPC ..... 102/494

(58) Field of Classification Search
USPC ..... 102/389, 491–497, 489, 475, 506
See application file for complete search history.

(56) References Cited

U.S. PATENT DOCUMENTS

| | | | | |
|---|---|---|---|---|
| 3,820,464 | A * | 6/1974 | Dixon | 102/493 |
| 4,312,274 | A * | 1/1982 | Zernow | 102/493 |
| 4,516,501 | A * | 5/1985 | Held et al. | 102/496 |
| 4,658,727 | A * | 4/1987 | Wilhelm et al. | 102/494 |
| 5,229,542 | A * | 7/1993 | Bryan et al. | 102/491 |
| 5,540,156 | A * | 7/1996 | Fong | 102/476 |
| 7,891,297 | B1 * | 2/2011 | Rohr | 102/492 |
| 8,061,275 | B1 * | 11/2011 | Gold | 102/495 |
| 8,161,884 | B1 * | 4/2012 | Kokodis et al. | 102/493 |
| 8,272,330 | B1 * | 9/2012 | Gold et al. | 102/494 |
| 8,276,520 | B1 * | 10/2012 | Fong et al. | 102/493 |

* cited by examiner

*Primary Examiner* — Michael Carone
*Assistant Examiner* — Reginald Tillman, Jr.
(74) *Attorney, Agent, or Firm* — Michael C. Sachs

(57) ABSTRACT

A fragmenting warhead is provided having an outer cylindrically shaped hollow steel shell which can be selectively detonated into different fragment types and sizes. The warhead has a plastic liner within said shell, and a core of explosive. There are a number of insulated wire grids of high electrical resistance which will heat when an electrical current is provided thereto located in intimate thermal contact with the explosive, each grid corresponding to a fragment type and size for selection by providing electrical current to that selected grid. Heat flux is caused when an electrical current runs through a particular grid and this selectively melts explosive in the near vicinity of such grid, then a detonation of the explosive core will result in a fragmentation type and pattern corresponding to that grid type and pattern. An ignition propellant train may also be selectively associated with wires on the grids to further selectively detonate the explosive. The plastic liner serves not only as electrical insulation, but also increases grid structural integrity, ease of manufacturing, thermal insulation, and IM qualities of the warhead.

9 Claims, 5 Drawing Sheets

SELECTABLE FRAGMENT SIZE FRAGMENTATION WARHEAD

CROSS REFERENCE TO RELATED APPLICATIONS

This application is a continuation-in-part of U.S. patent application Ser. No. 12/563,474, filed on Sep. 21, 2009 now abandoned, the entire file contents of which application are hereby incorporated by reference herein as though fully set forth.

U.S. GOVERNMENT INTEREST

The inventions described herein may be made, used, or licensed by or for the U.S. Government for U.S. Government purposes.

BACKGROUND AND SUMMARY OF INVENTION

Warhead fragmentation effectiveness is determined by the number, mass, shape, and velocity of the warhead's fragments. By using a controlled fragmentation design, warhead fragmentation can generally be achieved quickly and in a cost effective manner. Exemplary controlled fragmentation techniques are described in U.S. Pat. Nos. 3,491,694; 4,312,274; 4,745,864; 5,131,329; and 5,337,673. Further, U.S. Pat. No. 3,877,376 issued Apr. 15, 1975 to Vahey Kupelian, and U.S. Pat. No. 4,516,501 issued May 14, 1985 to Held et al., and U.S. Pat. No. 5,544,589 issued Aug. 13, 1996 to Manfred Held; U.S. Pat. No. 3,799,054 to Edward W. La Rocca, are also all hereby incorporated by reference herein as though fully set forth at length.

Conventional designs in general use "cutter" liners that form fragments by generating a complex pattern of high-velocity "penetrators" for fragmenting the shell. Although these conventional fragmentation designs have proven to be useful, it would be desirable to present additional functional, cost and safety improvements that minimize the warhead weight, reduce manufacture expenses, and advance current United States Insensitive Munition (IM) requirements.

What is needed in this art and heretofore unavailable is an explosive fragmentation ammunition with target adaptable fragmentation output and, more particularly, to a warhead having means for selectively controlling the size (and shapes) of fragments produced. According to an embodiment of this invention, controlling the size of fragments is accomplished through a pattern of grids of high electrical resistance metal wires comprising two or more separate electric circuits, each corresponding to the fragment sizes (and shapes) desired.

OBJECTS OF THE INVENTION

It is therefore an object of the present invention to provide a fragmenting warhead shell with means to selectively control fragment sizes, and;

It is a further object of the present invention to provide a fragmenting warhead shell with means to selectively melt a pattern of explosive to produce a relatively small size fragment or a relatively large size fragments in the fragmenting shell, and;

It is a still further object of the present invention to selectively melt and then lead away excessive molten explosive by vacuum into chambers in a plastic liner through side vents to selectively melt a pattern of explosive to produce a relatively small size fragment or relatively large size fragments in the fragmenting shell, and;

It is a yet another object of the present invention to selectively ignite a propellant train associated with wires on a grid to detonate a main explosive charge which will lead to relatively small size fragment or relatively large size fragments in the fragmenting shell.

These and other objects, features and advantages of the invention will become more apparent in view of the within detailed descriptions of the invention and in light of the following drawings, (not necessarily drawn to scale size), in which:

DETAILED DESCRIPTION

Figure 1:
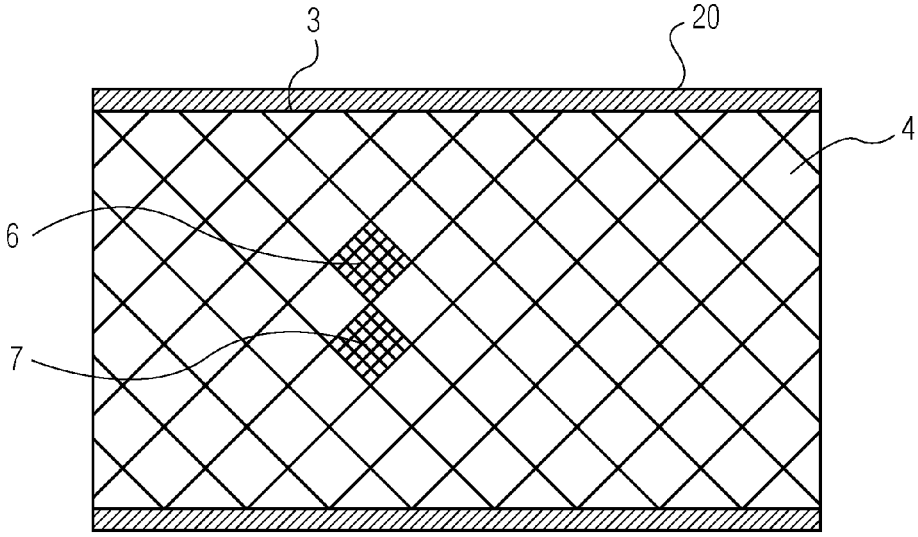
FIG. 1 shows a cross section and partial inside view of a fragmenting warhead shell which is intended to selectively fragment into either large or small size fragments according to one embodiment of the invention.
Figure 2A:
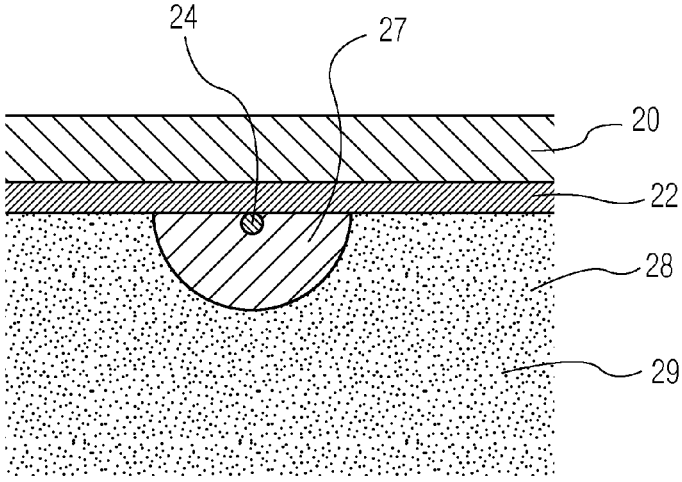
FIG. 2A shows a cross section and partial inside view of the previous fragmenting warhead shell showing the placement of the wire grid(s) against the explosive core so as to selectively melt a pattern of explosive to more or less match the grid(s) and FIG. 2B shows a rectangular cross sectional wire with its insulating portion, useful in constructing the electrical grid(s)
Figure 2B:
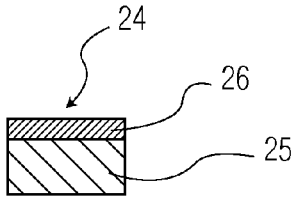

FIG. 1 shows a fragmenting warhead shell 20 which is intended to selectively fragment into large size fragments such as 3 or into small size fragments such as 6. The mechanism for initiating such fragmentation and differentiating size of such fragments begins with electrical grid 4 which leads to formation of large size fragments and electrical grid 7 which leads to formation of small size fragments. The pattern shown on these grids will ultimately show up on the breakage of shell 20. Not only may large or smaller sizes of fragments be thus produced, but any number of particular types of shapes, all corresponding to the patterns on the grid. The fragments are not limited to square or rectangular, for instance. These patterns of grids are of high electrical resistance metal wires as were shown in the embodiment, e.g., comprise two or more separate electric circuits, each corresponding to the fragment sizes desired. The grids are embedded within the explosive 28 as shown in FIG. 2A and are used to melt (but not to ignite) the explosive, ordinarily solid as shown by 29, into a molten state shown at 27 hopefully at those pattern locations (only). Each grid of high electrical resistance metal wires is disposed between the fragmenting steel shell 20 and the explosive 28, in intimate thermal contact with the explosive 28. A plastic liner 22 may be disposed between the wire grid(s) and the fragmenting shell 20 for grid structural integrity, for ease of manufacturing, for thermal and electrical insulation, and for IM (insensitive munition) enhancements. A predetermined time before initiating the explosive, an electrical voltage is applied to one of the wire-grid circuits, and the resulting electric current generates a heat flux melting adjacent explosive. It takes about 1 minute of time to melt the explosive, into the explosive pattern as desired here; it may be done in flight, for instance. One then has a pattern of molten state explosive 27 in lines that follow the patterns of the grids (4 or 7, or some combination of both) that was used to melt it; outside the grid patterns the explosive 28 is still in its solid state 29. An example of wire 24 is shown in FIG. 2B. To maximize heat flux to the explosive 28, the wire may have rectangular cross-section 25 with thermal electric insulation 26 provided, or else to rest on the plastic liner 22 for insulation purposes. Because of differences in the detonation velocities of the liquid and solid phase explosives, in the vicinities of the molten explosive regions, a pattern of detonation Mach Stems will form, resulting in a stamp like pattern of gradients of detonation pressures and momentum transferred to the fragmenting shell, ultimately replicating/stamping the pattern of the wire-grid with the desired fragment sizes onto the fragmenting shell. The explosive charge 28 could comprise for example, LX-14, OCTOL, hand packed C-4, or any other solid explosive, that can be machined, cast, or hand-packed to fit snugly within the inside of liner 22. The liner could be made of any suitable low-melt temperature material such as HDPE (High Density Poly Ethylene), or Accura SI 40 stereo lithographic material mimicking Nylon 6:6. Liner thickness could be approximately a fraction of a millimeter to several millimeters. It will be appreciated that the liner is made of a low melt-temperature plastic material to facilitate heat-induced melt out, further enhancing ammunition resistance to fire hazards wherein, in the event of unwanted heat or pressures of launch, the liner plastic melts and flows acting to seal the explosive from catastrophic fratricide, and further the melted plastic also tends to flow to exit the warhead to eliminate pressure within the body.

Figure 3:
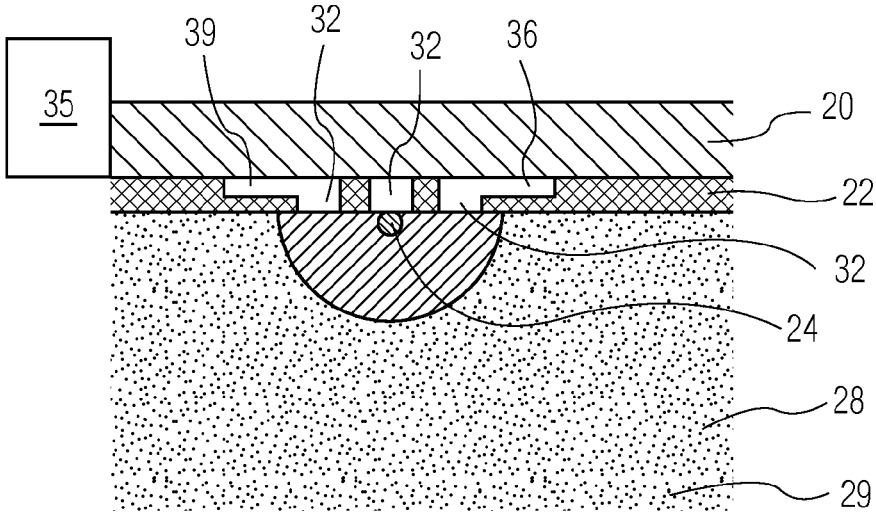
FIG. 3 shows a cross section of an alternative embodiment of the fragmenting warhead shell to selectively fragment, wherein excessive molten explosive is intended to be vacuum pulled away into chambers in a plastic liner through side vents.

According to another embodiment of the invention in FIG. 3, the plastic liner 22 may be provided with a series of vents 32 facilitating evacuation of molten explosive 27 into plastic liner cavity reservoirs 36 or chambers 39. To evacuate liquid explosive phase molten explosive 27 into any vents 32, reservoirs 36, or chambers 39, the plastic liner should be under negative pressure; e.g. under a vacuum by a vacuum creating means 35 (details not shown).

Figure 4:
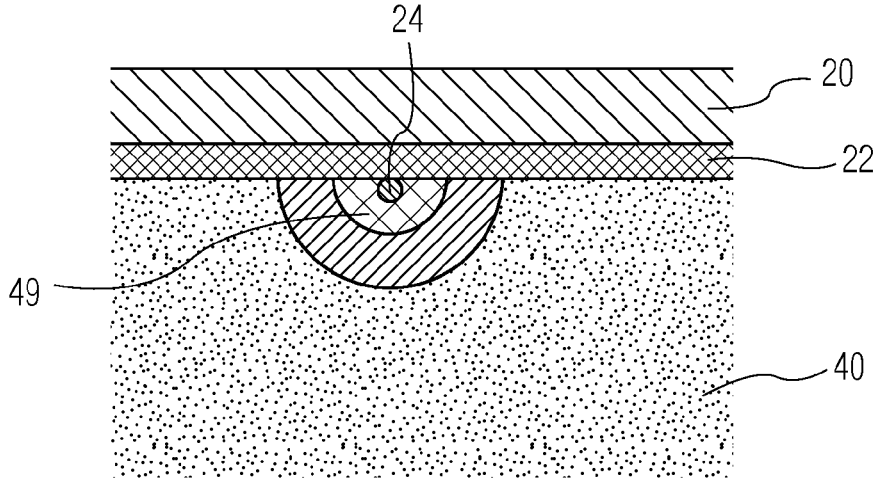
FIG. 4 shows a cross section of a still further embodiment of the fragmenting warhead shell to selectively fragment, wherein an ignition propellant train is selectively associated with the wires on the grid(s) to detonate a main explosive charge is selectively detonated, such detonation ultimately causing selective fragmentation of the warhead shell according to the patterns on the grid(s).

According to yet further embodiment of the invention in FIG. 4, heat flux from a high electrical resistance wire 24 (formed in patterns of wire-grid(s), such as 4 and 7, or some combination of both, not completely shown here), initiates an igniter 49, and igniter 49 then starts the explosive 46 burning (or some form of propellant in certain other embodiments). Under these conditions of confinement, propellant deflagration will transition into a detonation that will initiate a main explosive charge 40. The collision of the detonation waves will generate a Mach Stem like pattern of high pressure regions, ultimately replicating/stamping patterns like the wire-grid(s), with the desired fragment sizes, onto the fragmenting shell 20.

Figure 5:
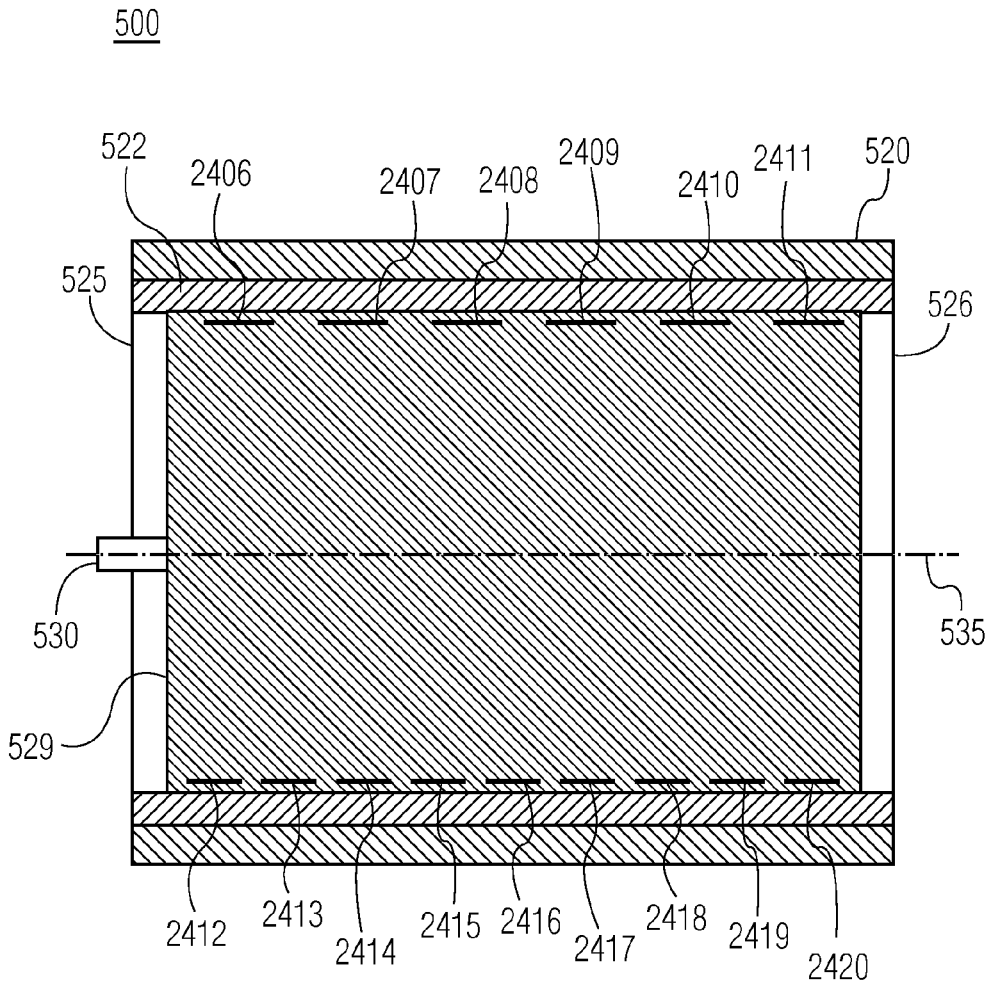
FIG. 5 illustrates a cross section of a warhead 500, utilizing a multi-fragmenting cylindrically shaped fragmenting liner 520 that is explosively stamped.
Figure 6:
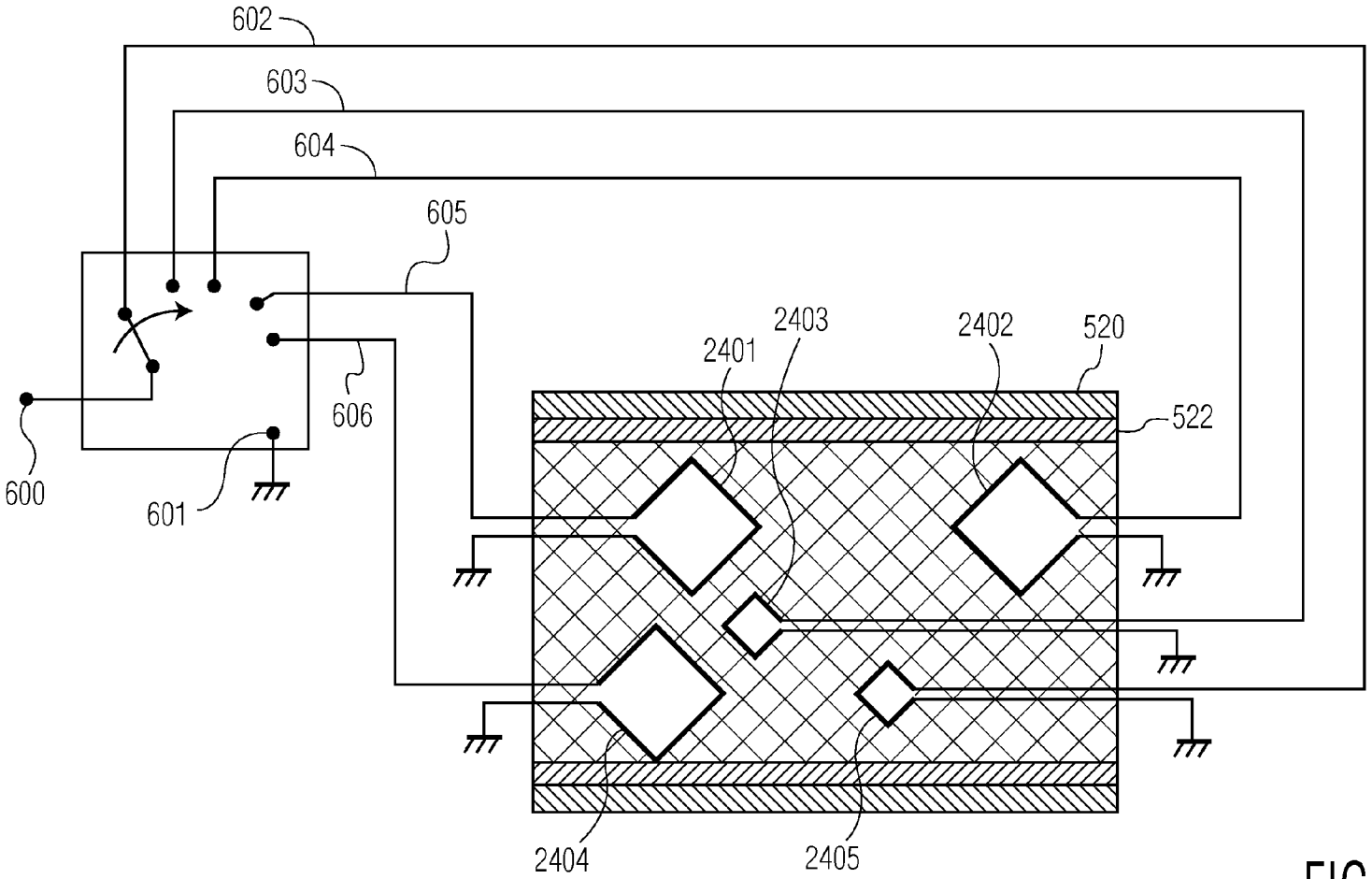
FIG. 6 illustrates a cross sectional view of the warhead 500 with explosive charge 529 not present, with exemplary patches 2401 through 2405 seen lying positioned on the inside contour of the liner 522, for example.
Figure 7:
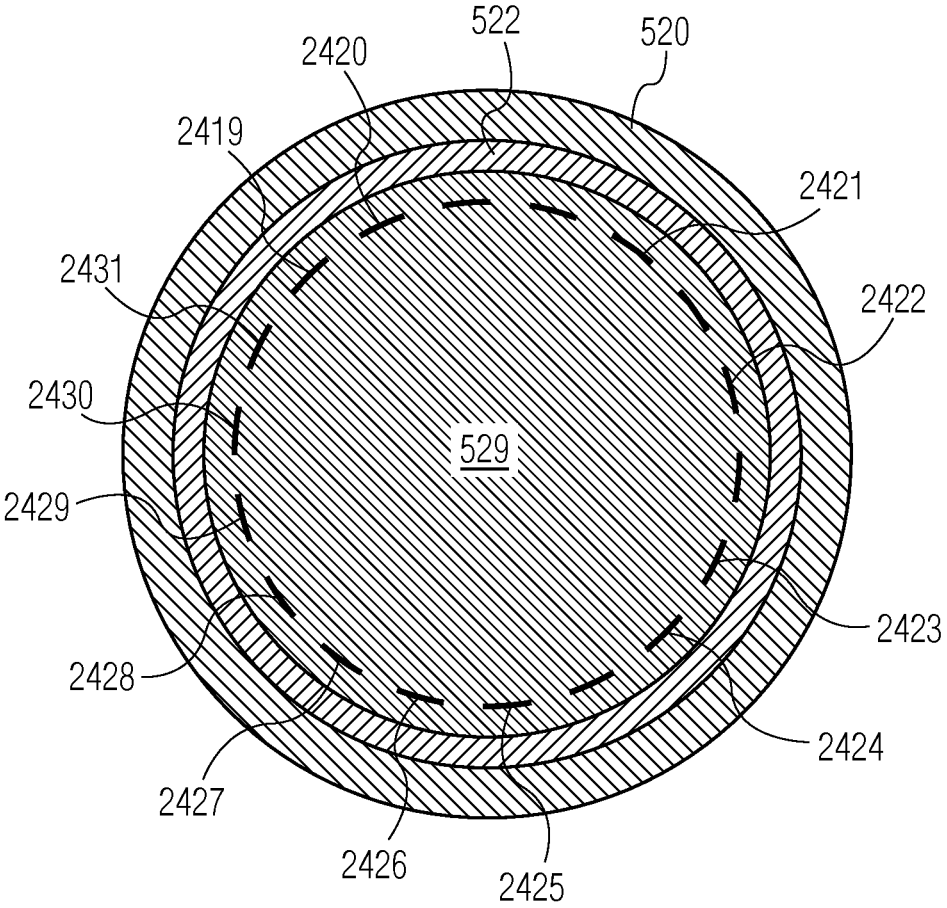
FIG. 7 shows a side view cross sectional view of warhead 500 of FIG. 5.

FIG. 5 generally illustrates a cross section of a warhead 500, utilizing a multi-fragmenting cylindrically shaped fragmenting liner 520 that is explosively stamped. Warhead 500 having center line 535 further comprises a fore plate 525, back plate 510, a main explosive charge 529, and an initiation mechanism assembly 530, and plastic liner 529. Exemplary electrical wiring patches 2406-2418 etc., (seen only on an end view as approximating short straight lines) are represented as being positioned directly adjacent along the inside surface of plastic liner 522. If plastic liner 522 is not used, then the electrical wiring patches would be positioned directly adjacent along the inside surface of fragmenting liner 520. In the FIG. 6 cross sectional view of the warhead with explosive charge 529 not present, exemplary patches 2401 through 2405 are seen lying positioned on the inside contour of the liner 522, e.g. In FIG. 7 a side view cross sectional view of FIG. 5 is shown. Here, exemplary patches such as 2419-2431 (seen only on an end view as approximating short curved lines) are represented as being positioned directly adjacent along the inside surface of plastic liner 522. In FIG. 6, each patch is represented as being connected to its own power up line (such as exemplary lines 602-606) and also to a second line going to a ground. Power source 600 (grounded at 601, e.g.), selectively can power up an individual patch or selected patches as desired. (For example, power source 600 can be used to power up just smaller dimensioned patches only, for eventual use of the warhead to generate relatively smaller dimensioned fragments for use against anti-personnel targets). As mentioned earlier, the patches heat up though electrical current passing through the resistant wires. This heat melts the explosive in the vicinity of the patch lines, in a design roughly of molten (but unexploded) explosive approximately the same as a heated patch, after approximately a minute. Thereafter, the warhead main explosive charge 529 would be ready to be detonated by initiation means 530, e.g. The collision of the detonation waves will generate a Mach Stem like pattern of high pressure regions, ultimately replicating/stamping patterns like the wire-grid(s), with the desired like fragment sizes, onto the fragmenting shell 520. Means 600 which could employ commonly available digital switch circuit means, could if desired be commanded from a processor/telemetry means which has determined a target and calculated/decided what type fragments to use against such target. Means 600 could also be manually operated to select lead lines for powering with current, or commanded manually from a ground station to a flying munition, e.g. Such melting of the main explosive charge material would merely cause a melting in patch outline locations. The decision of when/where to melt and then to ignite the explosive material, and in what patterns, can be done automatically/manually while in flight, such as while homing in on a particular target, when the nature of the target is discerned either automatically/manually such as by target detection equipment. As mentioned, then the eventual fragmentation will be generally along the lines of such molten explosive lines.

While the invention has been described with reference to certain embodiments, numerous changes, alterations and modifications to the described embodiments are possible without departing from the spirit and scope of the invention as defined in the appended claims, and equivalents thereof.

What is claimed is:

1. A fragmenting warhead having an outer hollow steel shell which can be selectively detonated into different fragment sizes, said warhead comprising:

a core of explosive filling the interior of said outer hollow steel shell;

a number of electrically insulated wire grids located in intimate thermal contact with said core of explosive and along the interior of said outer hollow steel shell, each grid corresponding to a fragment type and size for selection by providing electrical current to that selected grid; and means for selectively providing electrical current to at least one of the grids.

2. The fragmenting warhead of claim 1, wherein the wire of the grids is electrically resistant that will heat when an electrical current is provided thereto.

3. The fragmenting warhead of claim 2, wherein heat flux caused when an electrical current runs through a particular grid selectively melts explosive in the near vicinity of such grid, and then a detonation of the explosive core will result in a fragmentation type and pattern corresponding to the grid type and pattern.

4. The fragmenting warhead of claim 2, wherein the wire is of rectangular cross section, having an electrical insulation thereon.

5. A fragmenting warhead having an outer hollow steel shell which can be selectively detonated into different fragment sizes, said warhead comprising:

a hollow cylindrical plastic liner within said outer hollow steel shell, said liner having a defined thickness;

a core of explosive filling the interior of said plastic liner;

a number of insulated wire grids of high electrical resistance which will heat when an electrical current is provided thereto, located in intimate thermal contact with said core of explosive and along the interior of said hollow cylindrical plastic liner, each grid corresponding to a fragment size for selection by providing electrical current to that selected grid; and means for selectively providing electrical current to at least one of the grids.

6. The fragmenting warhead of claim 5, wherein the plastic liner serves as the electrical insulation thereon, and also increases grid structural integrity, ease of manufacturing, thermal and electrical insulation, and IM qualities of the warhead.

7. The fragmenting warhead of claim 6, wherein heat flux caused when an electrical current runs through a particular grid selectively melts explosive in the near vicinity of such grid, and then a detonation of the explosive core will result in a fragmentation type and pattern corresponding to the grid type and pattern.

8. The fragmenting warhead of claim 2, wherein relatively larger dimensioned rectangular fragments versus relatively smaller dimensioned rectangular fragments may be selected for a particular target use.

9. The fragmenting warhead of claim 7, wherein an ignition propellant train is selectively associated with wires on the grids to further selectively detonate the explosive, such detonation ultimately causing selective fragmentation of the warhead shell according to the patterns on a selected grid.

* * * * *